US007377196B1

(12) United States Patent
Chen

(10) Patent No.: US 7,377,196 B1
(45) Date of Patent: May 27, 2008

(54) CORKSCREW HAVING AN ANGLE ADJUSTABLE FUNCTION

(76) Inventor: Hsing-Hui Chen, 7F-1, No. 345, Bo-Ai 2nd Rd., Gushan District, Kaohsiung City (TW)

( * ) Notice: Subject to any disclaimer, the term of this patent is extended or adjusted under 35 U.S.C. 154(b) by 0 days.

(21) Appl. No.: 11/714,543

(22) Filed: Mar. 6, 2007

(51) Int. Cl.
*B67B 7/04* (2006.01)

(52) U.S. Cl. ..... 81/3.36; 81/3.48; 81/3.47; 81/3.45

(58) Field of Classification Search ..... 81/3.55, 81/3.47, 3.56, 3.57, 3.48, 3.49, 3.45, 3.36, 81/3.29, 3.37
See application file for complete search history.

(56) References Cited

U.S. PATENT DOCUMENTS 4,584,911 A * 4/1986 Cellini ..... 81/3.36
5,454,282 A * 10/1995 Del Mistro ..... 81/3.48
6,101,900 A * 8/2000 Traspuesto Miguel ..... 81/3.48
6,116,116 A * 9/2000 Brucart Puig et al. ..... 81/3.37
6,732,611 B2 * 5/2004 Miguel ..... 81/3.29
6,752,040 B1 * 6/2004 Paul-Alexandre et al. ... 81/3.09
2003/0126954 A1 * 7/2003 Lefebvre ..... 81/3.47
2007/0125200 A1 * 6/2007 Cellini ..... 81/3.09

* cited by examiner

*Primary Examiner*—D. S Meislin
(74) *Attorney, Agent, or Firm*—Alan Kamrath; Kamrath & Associates PA

(57) ABSTRACT

A corkscrew includes a support member having two opposite sliding slots, a movable rod slidably mounted in the sliding slots of the support member, a resting member mounted on the support member, a screw member mounted on the support member, a cover mounted on the support member, and a pull handle pivotally mounted on the cover and formed with a tongue located between the sliding slots of the support member and the movable rod. Thus, the angle between the pull handle and the support member is adjustable, so that the user can pull the pull handle upward relative to the support member to pull the cork of the bottle upward successively until the cork is removed from the bottle so as to remove the cork from the bottle easily and conveniently.

20 Claims, 5 Drawing Sheets

CORKSCREW HAVING AN ANGLE ADJUSTABLE FUNCTION

BACKGROUND OF THE INVENTION

1. Field of the Invention

The present invention relates to a corkscrew and, more particularly, to a corkscrew to remove a cork from a wine bottle.

2. Description of the Related Art

A conventional corkscrew in accordance with the prior art shown in FIG. 5 comprises a pull handle 14, a resting member 11 pivotally mounted on the pull handle 14 and provided with a recessed resting portion 12, and a screw member 13 pivotally mounted on the pull handle 14. In operation, the resting member 11 and the screw member 13 are expanded outwardly from the pull handle 14. Then, the screw member 13 is screwed into a cork 15 of a bottle 10 until the resting portion 12 of the resting member 11 is rested on the mouth 16 of the bottle 10. Then, the pull handle 14 is pulled upward to pull the cork 15 of the bottle 10 upward gradually.

However, when the pull handle 14 reaches the largest rising angle, the pulling force applied by the pull handle 14 on the cork 15 cannot pull the cork 15 of the bottle 10 upward any more. At this time, one part of the cork 15 protrudes from the bottle 10, and the other part of the cork 15 remains in the bottle 10, so that the user needs to apply a force on the cork 15 so as to pull and remove the cork 15 from the bottle 10 completely, thereby greatly causing inconvenience to the user.

BRIEF SUMMARY OF THE INVENTION

In accordance with the present invention, there is provided a corkscrew, comprising a support member having two opposite elongated sliding slots, a movable rod slidably mounted in the sliding slots of the support member, a resting member pivotally mounted on the support member, a screw member pivotally mounted on the support member, a cover mounted on the support member, and a pull handle having a first end pivotally mounted on the cover and formed with a protruding tongue located between the sliding slots of the support member and the movable rod.

The primary objective of the present invention is to provide a corkscrew having an angle adjustable function.

Another objective of the present invention is to provide a corkscrew, wherein the angle between the pull handle and the support member is adjustable when the pull handle reaches the largest rising angle, so that the user can pull the pull handle upward relative to the support member to pull the cork of the bottle upward successively until the cork is removed from the bottle so as to remove the cork from the bottle easily and conveniently.

A further objective of the present invention is to provide a corkscrew, wherein the pull handle is pivotable relative to the support member to remove the cork from the bottle by a leverage action, so that the user can remove the cork from the bottle easily and quickly, thereby facilitating the user removing the cork from the bottle.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
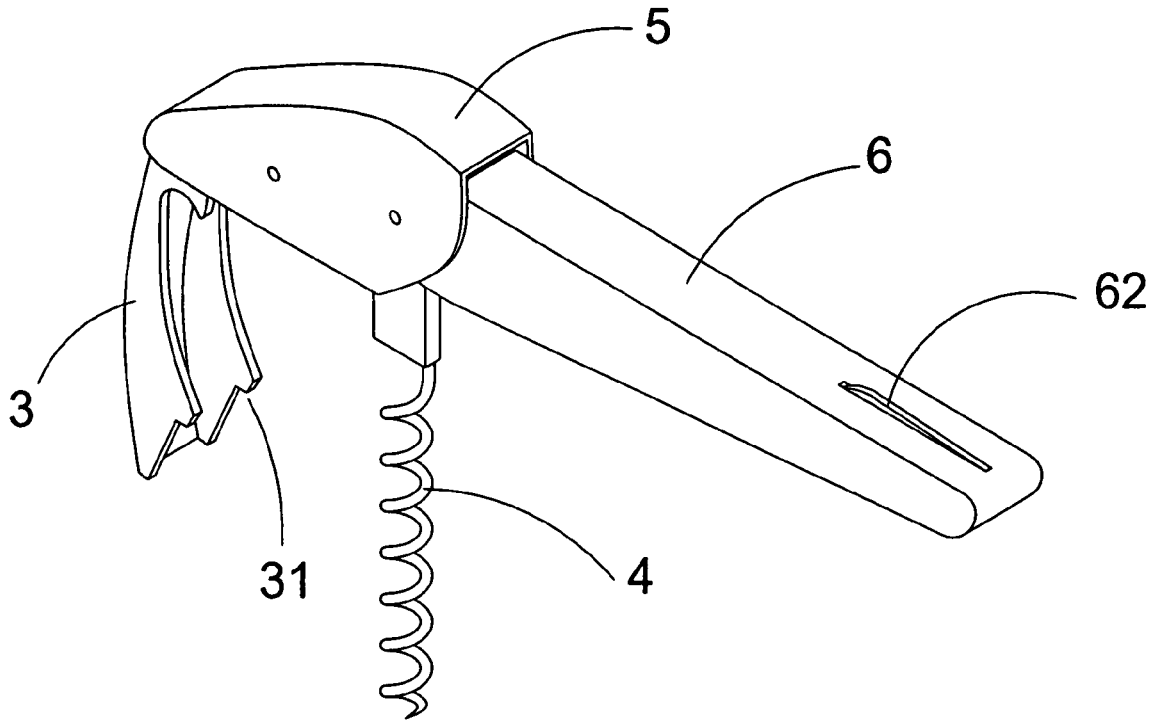
FIG. 1 is a perspective view of a corkscrew in accordance with the preferred embodiment of the present invention.
Figure 2:
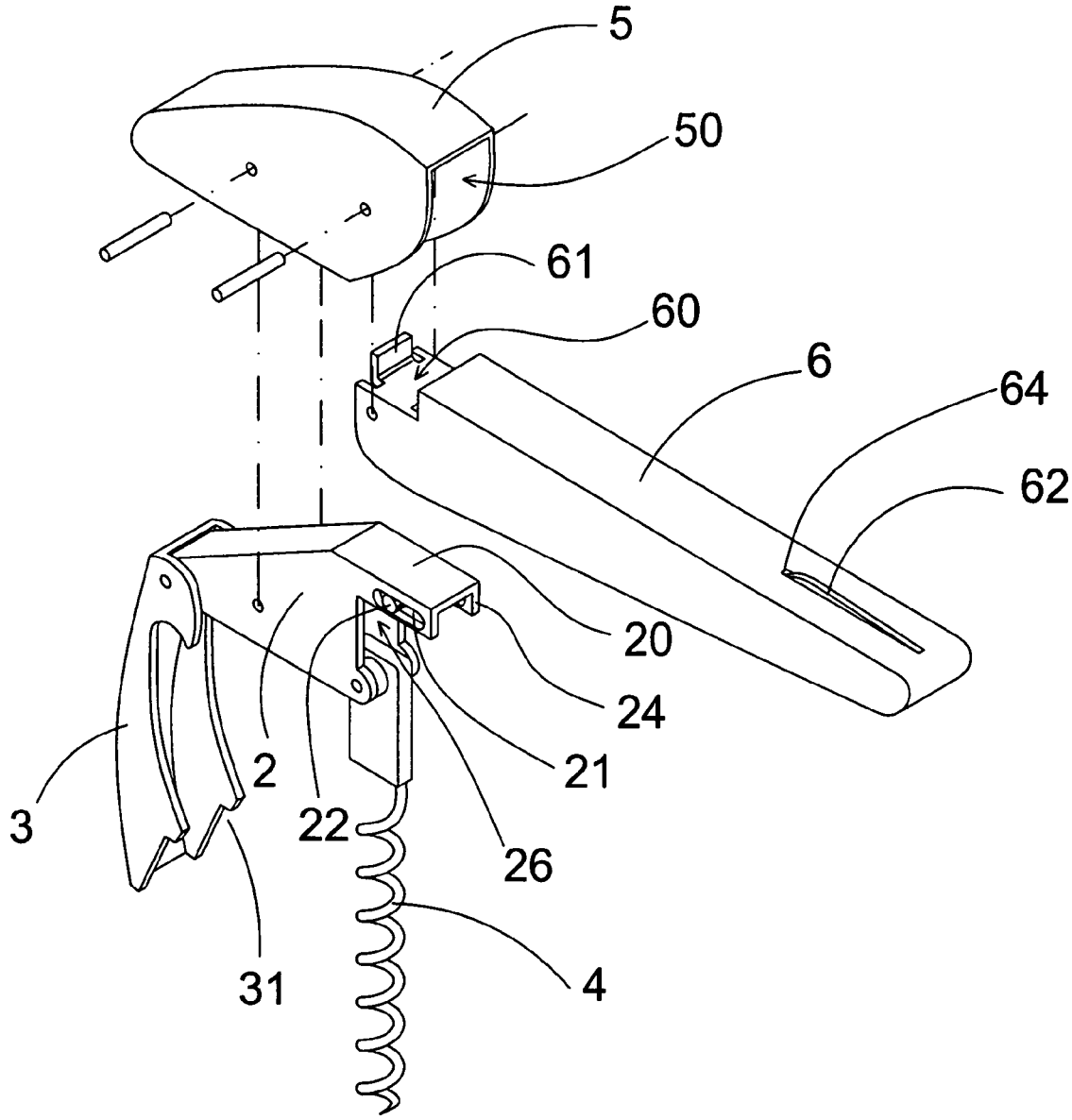
FIG. 2 is an exploded perspective view of the corkscrew as shown in FIG. 1.
Figure 3:
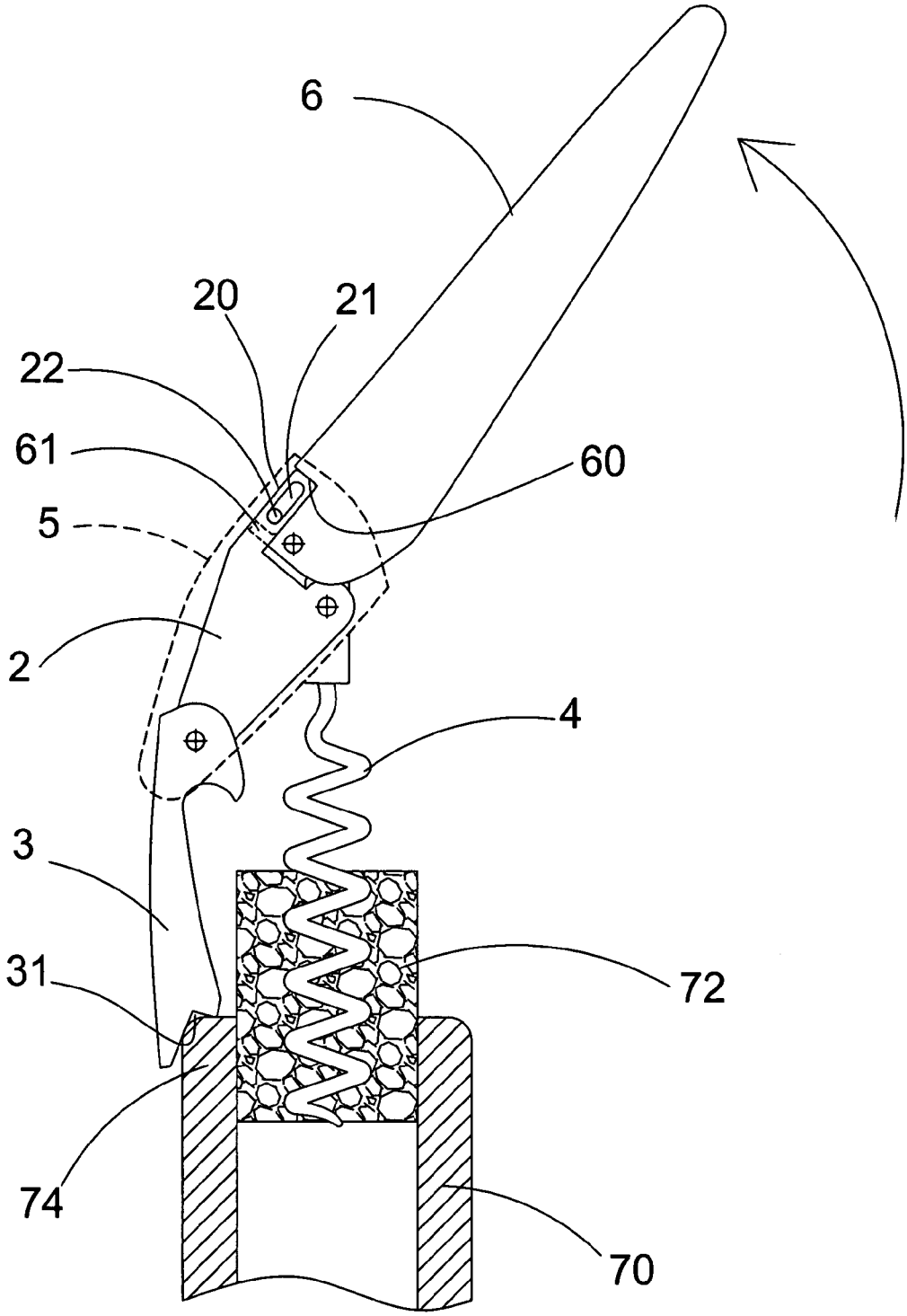
FIG. 3 is a side cross-sectional view of the corkscrew as shown in FIG. 1.

Referring to the drawings and initially to FIGS. 1-3, a corkscrew in accordance with the preferred embodiment of the present invention comprises a support member 2 having two opposite elongated sliding slots 21, a movable rod 22 slidably mounted in the sliding slots 21 of the support member 2, a resting member 3 pivotally mounted on the support member 2, a screw member 4 pivotally mounted on the support member 2, a cover 5 mounted on the support member 2, and a pull handle 6 having a first end pivotally mounted on the cover 5 and formed with a protruding tongue 61 located between the sliding slots 21 of the support member 2 and the movable rod 22.

The support member 2 has a first end provided with an extension 20 having two downward extending side walls 24, and each of the sliding slots 21 of the support member 2 is formed in a respective side wall 24 of the support member 2. The first end of the support member 2 is formed with a receiving recess 26 connected to the extension 20 to receive the first end of the pull handle 6. The extension 20 of the support member 2 has a substantially inverted U-shaped cross-sectional profile.

The movable rod 22 is movable in the extension 20 of the support member 2 and has two opposite ends each slidable in a respective sliding slot 21 of the support member 2.

The cover 5 is enclosed around an outer periphery of the support member 2 so that the support member 2 is fully hidden in the cover 5. The cover 5 has a substantially inverted U-shaped cross-sectional profile and has an inside formed with a receiving chamber 50 to receive the support member 2 and to receive the first end of the pull handle 6. The cover 5 has a first end pivotally mounted on a mediate portion of the support member 2 and a second end pivotally mounted on the first end of the pull handle 6.

The first end of the pull handle 6 is formed with a recessed receiving portion 60 rested on the extension 20 of the support member 2. The tongue 61 of the pull handle 6 is perpendicular to the support member 2. The tongue 61 of the pull handle 6 is movable in the extension 20 of the support member 2 and is movable to rest on the movable rod 22.

Thus, the pull handle 6 is pivotable relative to the support member 2 between a first position where the pull handle 6 is in line with the support member 2, and the tongue 61 of the pull handle 6 is spaced from the movable rod 22, and a second position where the pull handle 6 is inclined relative to the support member 2, and the tongue 61 of the pull handle 6 is rested on the movable rod 22.

The corkscrew further comprises a blade 62 pivotally mounted on a second end of the pull handle 6, and the second end of the pull handle 6 is formed with a receiving groove 64 to receive the blade 62. The blade 62 is received in the receiving groove 64 of the pull handle 6 at a normal state to reduce the whole volume of the pull handle 6.

The screw member 4 is pivotally mounted on the first end of the support member 2 and located under the first end of the pull handle 6.

The resting member 3 is pivotally mounted on a second end of the support member 2 and is provided with a recessed resting portion 31.

Figure 4:
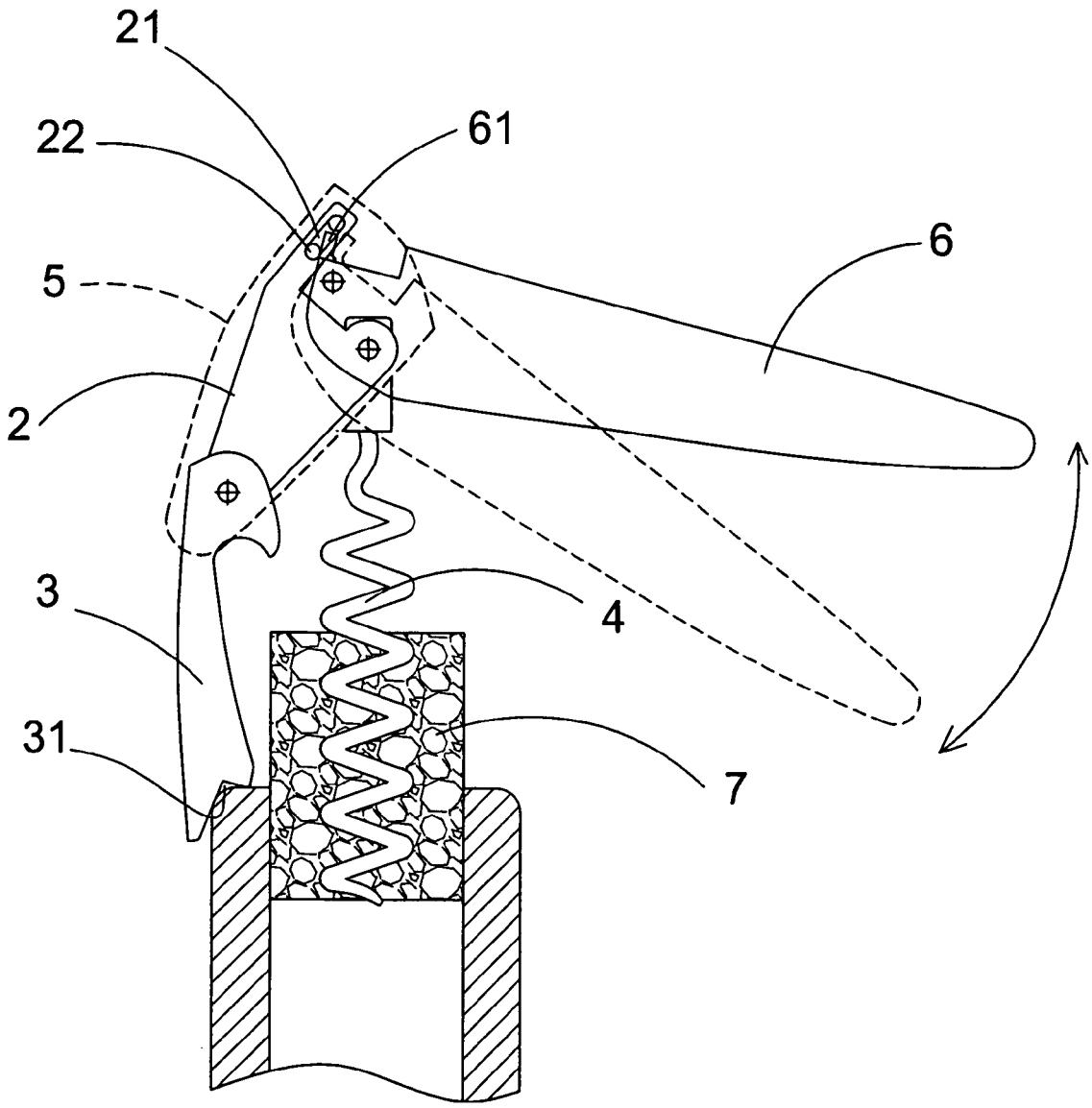
FIG. 4 is a schematic operational view of the corkscrew as shown in FIG. 3.
Figure 5:
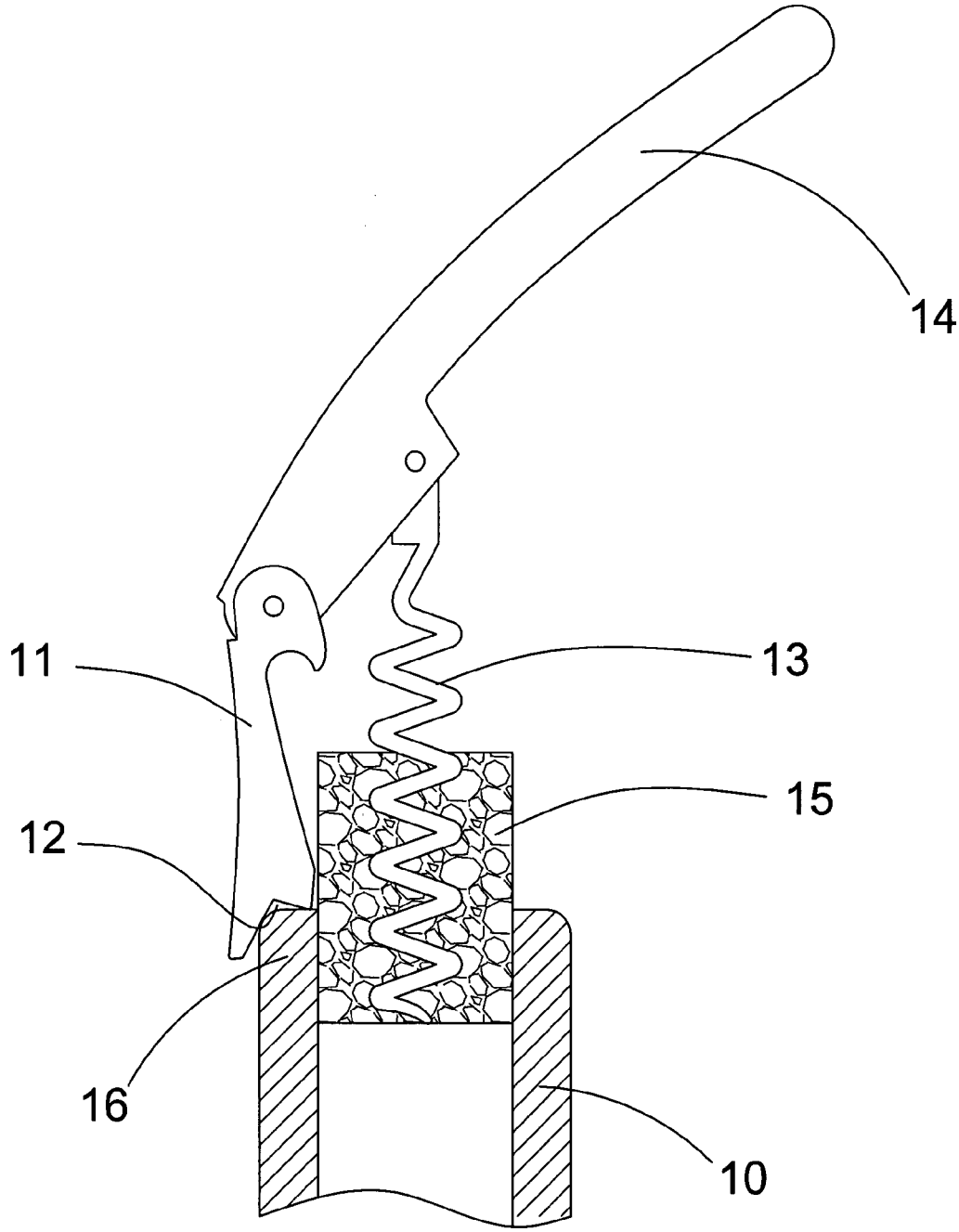
FIG. 5 PRIOR ART
FIG. 5 is a side cross-sectional view of a conventional corkscrew in accordance with the prior art.

In operation, referring to FIGS. 3 and 4 with reference to FIGS. 1 and 2, the resting member 3 and the screw member 4 are expanded outwardly from the support member 2, and the pull handle 6 is in line with the support member 2. Then, the screw member 4 is screwed into a cork 72 of a bottle 70 until the resting portion 31 of the resting member 3 is rested on the mouth 74 of the bottle 70. Then, the pull handle 6 is pulled upward relative to the support member 2 to pull the cork 72 of the bottle 70 upward gradually.

As shown in FIG. 4, when the pull handle 6 reaches the largest rising angle and the user cannot apply the pulling force easily, the pull handle 6 is initially pressed downward relative to the support member 2 and then pulled upward relative to the support member 2. When the pull handle 6 is pressed downward relative to the support member 2, the tongue 61 of the pull handle 6 is movable toward the movable rod 22 to push the movable rod 22 until the tongue 61 of the pull handle 6 crosses a first side of the movable rod 22 and abuts a second side of the movable rod 22. When the pull handle 6 is pulled upward relative to the support member 2, the tongue 61 of the pull handle 6 is movable to rest on the movable rod 22 to reduce the rising angle of the pull handle 6, so that the user can pull the pull handle 6 successively to pull the cork 72 of the bottle 70 upward until the cork 72 is removed from the bottle 70.

Accordingly, the angle between the pull handle 6 and the support member 2 is adjustable when the pull handle 6 reaches the largest rising angle, so that the user can pull the pull handle 6 upward relative to the support member 2 to pull the cork 72 of the bottle 70 upward successively until the cork 72 is removed from the bottle 70 so as to remove the cork 72 from the bottle 70 easily and conveniently. In addition, the pull handle 6 is pivotable relative to the support member 2 to remove the cork 72 from the bottle 70 by a leverage action, so that the user can remove the cork 72 from the bottle 70 easily and quickly, thereby facilitating the user removing the cork 72 from the bottle 70.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A corkscrew, comprising:

a support member having two opposite elongated sliding slots;

a movable rod slidably mounted in the sliding slots of the support member;

a resting member pivotally mounted on the support member;

a screw member pivotally mounted on the support member;

a cover mounted on the support member;

a pull handle having a first end pivotally mounted on the cover and formed with a protruding tongue located between the sliding slots of the support member and the movable rod.

2. The corkscrew in accordance with claim 1, further comprising a blade pivotally mounted on a second end of the pull handle.

3. The corkscrew in accordance with claim 2, wherein the second end of the pull handle is formed with a receiving groove to receive the blade which is received in the receiving groove of the pull handle at a normal state to reduce a whole volume of the pull handle.

4. The corkscrew in accordance with claim 1, wherein the pull handle is pivotable relative to the support member so that an angle between the pull handle and the support member is adjustable.

5. The corkscrew in accordance with claim 1, wherein the support member has a first end provided with an extension having two downward extending side walls, and each of the sliding slots of the support member is formed in a respective side wall of the support member.

6. The corkscrew in accordance with claim 5, wherein the first end of the support member is formed with a receiving recess connected to the extension to receive the first end of the pull handle.

7. The corkscrew in accordance with claim 5, wherein the extension of the support member has a substantially inverted U-shaped cross-sectional profile.

8. The corkscrew in accordance with claim 5, wherein the movable rod is movable in the extension of the support member.

9. The corkscrew in accordance with claim 1, wherein the movable rod has two opposite ends each slidable in a respective sliding slot of the support member.

10. The corkscrew in accordance with claim 1, wherein the cover is enclosed around an outer periphery of the support member so that the support member is fully hidden in the cover.

11. The corkscrew in accordance with claim 1, wherein the cover has a substantially inverted U-shaped cross-sectional profile.

12. The corkscrew in accordance with claim 1, wherein the cover has an inside formed with a receiving chamber to receive the support member and to receive the first end of the pull handle.

13. The corkscrew in accordance with claim 1, wherein the cover has a first end pivotally mounted on a mediate portion of the support member and a second end pivotally mounted on the first end of the pull handle.

14. The corkscrew in accordance with claim 5, wherein the first end of the pull handle is formed with a recessed receiving portion rested on the extension of the support member.

15. The corkscrew in accordance with claim 1, wherein the tongue of the pull handle is perpendicular to the support member.

16. The corkscrew in accordance with claim 5, wherein the tongue of the pull handle is movable in the extension of the support member and is movable to rest on the movable rod.

17. The corkscrew in accordance with claim 1, wherein the pull handle is pivotable relative to the support member between a first position where the pull handle is in line with the support member, and the tongue of the pull handle is spaced from the movable rod, and a second position where the pull handle is inclined relative to the support member, and the tongue of the pull handle is rested on the movable rod.

18. The corkscrew in accordance with claim 5, wherein the screw member is pivotally mounted on the first end of the support member and located under the first end of the pull handle, and the resting member is pivotally mounted on a second end of the support member and is provided with a recessed resting portion.

19. The corkscrew in accordance with claim 1, wherein the pull handle is initially pressed downward relative to the support member and then pulled upward relative to the support member.

20. The corkscrew in accordance with claim 19, wherein:

when the pull handle is pressed downward relative to the support member, the tongue of the pull handle is movable toward the movable rod to push the movable rod until the tongue of the pull handle crosses a first side of the movable rod and abuts a second side of the movable rod;

when the pull handle is pulled upward relative to the support member, the tongue of the pull handle is movable to rest on the movable rod.

* * * * *